US007836535B2

(12) United States Patent
Choi et al.

(10) Patent No.: US 7,836,535 B2
(45) Date of Patent: Nov. 23, 2010

(54) DISHWASHER AND A METHOD FOR CONTROLLING THE SAME

(75) Inventors: Soung Bong Choi, Changwon-si (KR); Sangheon Yoon, Gwangmyeong-si (KR); Nungseo Park, Seoul (KR); Dae Yeong Han, Seoul (KR); Hung Myong Cho, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 893 days.

(21) Appl. No.: 10/558,098

(22) PCT Filed: Sep. 13, 2005

(86) PCT No.: PCT/KR2005/003026

§ 371 (c)(1),
(2), (4) Date: Mar. 19, 2007

(87) PCT Pub. No.: WO2006/031057

PCT Pub. Date: Mar. 23, 2006

(65) Prior Publication Data

US 2007/0272283 A1 Nov. 29, 2007

(30) Foreign Application Priority Data

Sep. 14, 2004 (KR) ..... 10 2004 0073400
Sep. 22, 2004 (KR) ..... 10 2004 0075851

(51) Int. Cl.
*D06F 33/02* (2006.01)

(52) U.S. Cl. ..... 8/159; 68/12.02

(58) Field of Classification Search ..... 8/159; 134/113; 68/12.02
See application file for complete search history.

(56) References Cited

U.S. PATENT DOCUMENTS 3,613,405 A 10/1971 Smimokusu et al.

(Continued)

FOREIGN PATENT DOCUMENTS

DE 197 45 428 * 5/1998

(Continued)

OTHER PUBLICATIONS

International Search Report from the European Patent Office dated Jan. 13, 2006.

*Primary Examiner*—Frankie L Stinson
(74) *Attorney, Agent, or Firm*—McKenna Long & Aldridge LLP

(57) ABSTRACT

The present invention relates to dishwashers, and more particularly, to a dishwasher and a method for controlling the same, which can measure turbidity of the washing water, and control operation of the dishwasher with reference to the turbidity detected thus, to prevent wasting of water, and optimize a washing time period.

The dishwasher includes a sump for holding washing water, a washing pump for pumping the washing water to provide a portion of the washing water to dishes to be washed through a main flow passage, and a turbidity sensing means for sensing turbidity of the washing water, wherein the turbidity sensing means is positioned at a sampling flow passage through which the other portion of the washing water passes.

The method for controlling a dishwasher includes the steps of putting a washing pump into operation, detecting turbidity of the washing water, adjusting a washing time period preset at a control unit according to the turbidity detected thus, and operating the washing pump according to the washing time period adjusted thus.

6 Claims, 14 Drawing Sheets

U.S. PATENT DOCUMENTS

| | | | | | |
|---|---|---|---|---|---|
| 3,807,418 | A | * | 4/1974 | Jenkins | 134/57 D |
| 3,870,417 | A | | 3/1975 | Bashark | |
| 4,559,959 | A | * | 12/1985 | Meyers | 134/56 D |
| 4,653,294 | A | | 3/1987 | Akinaga | |
| 5,165,433 | A | | 11/1992 | Meyers | |
| 5,241,845 | A | * | 9/1993 | Ishibashi et al. | 68/12.02 |
| 5,429,146 | A | | 7/1995 | Graf et al. | |
| 5,446,531 | A | | 8/1995 | Boyer et al. | |
| 5,469,719 | A | * | 11/1995 | Imai et al. | 68/12.04 |
| 5,669,983 | A | * | 9/1997 | Cooper et al. | 134/18 |
| 6,456,375 | B1 | | 9/2002 | Otten et al. | |
| 2003/0019510 | A1 | | 1/2003 | Hegeman et al. | |
| 2003/0213503 | A1 | | 11/2003 | Price et al. | |

FOREIGN PATENT DOCUMENTS

| | | | | |
|---|---|---|---|---|
| EP | 1180344 | A2 | | 2/2002 |
| JP | 02-023995 | | * | 1/1990 |
| JP | 02-102698 | | * | 4/1990 |
| JP | 03-168185 | | * | 7/1991 |
| JP | 03-168189 | | * | 7/1991 |
| JP | 04-220289 | | * | 8/1992 |
| JP | 4-240485 | | | 8/1992 |
| JP | 06-022897 | A | | 2/1994 |
| JP | 06-063279 | | * | 3/1994 |
| JP | 6-285286 | | | 10/1994 |
| KR | 1998-036847 | | | 8/1998 |
| KR | 1998-0041194 | | | 8/1998 |

* cited by examiner

DISHWASHER AND A METHOD FOR CONTROLLING THE SAME

This application claims priority to International Application No. PCT/KR2005/00003026 filed on Sep. 13, 2005, as well as Korean Applications P 2004-73400 filed on Sep. 14, 2004 and P 2004-75851 filed on Sep. 22, 2004, all of which are incorporated by reference, as if fully set forth herein.

TECHNICAL FIELD

The present invention relates to dishwashers, and more particularly, to a dishwasher and a method for controlling the same, which can measure turbidity of the washing water, and control operation of the dishwasher with reference to the turbidity detected thus, to prevent wasting of water, and optimize a washing time period.

BACKGROUND ART

A related art dishwasher will be described with reference to the attached drawings.

Referring to FIG. 1, the related art dishwasher is provided with a tub 1 having upper/lower arms 4/5, upper/lower racks 6, and 7, and a driving unit 10 mounted therein.

The driving unit 10 has upper/lower connection pipes 2, and 3 connected thereto for pumping washing water, and a drain hose 9 connected thereto for draining the washing water, and the upper/lower connection pipes 2, and 3 have upper/lower spray arms 4, and 5 connected thereto. Over the upper spray arm 4, there is an upper rack 6, and over the lower spray arm 5, there is a lower rack 7.

The upper/lower spray arms 4, and 6 are rotatably mounted over the driving unit 10. The spray arms have spray holes formed therein for spraying washing water to the racks, respectively. Moreover, the lower spray arm has an additional spray hole for spraying away soil from a filter on the driving unit.

The driving unit of the dishwasher will be described in detail with reference to FIG. 2.

The driving unit of the dishwasher is provided with a sump 20 for holding the washing water therein, a heater 30 at the sump for heating the washing water, a washing pump 40 at the sump for pumping the washing water, a drain pump 50 at the sump for draining the washing water, and filtering means for guiding a portion of the washing water pumped thus, and filtering rest of the washing water.

The sump 20 has a washing water holding portion 21 for holding the washing water therein actually, and a drain chamber 22 separate from the holding portion 21. On an outside of the washing water holding portion, there is a flow control unit 25 having a flow control valve 26 coupled thereto with a shaft.

The washing pump 40 is provided with a washing motor 41 under the sump 20 for generating driving force, and an impeller 42 at the filtering means for pumping the washing water. The impeller is coupled to the washing motor with a shaft.

The drain pump 50 is mounted to the drain chamber 22. The drain pump is provided with a drain motor, and an impeller.

The filtering means is provided with a pump housing 60 having a space for mounting the impeller 42 thereto, a filter housing 70 for covering the pump housing, and a cover 80 for covering the filter housing and the sump. Under the filter housing, there is the pump housing, and over the filter housing there is the cover.

The filter housing has a soil chamber 75, and so on, and the soil chamber has a drain 75*a* in communication with the drain chamber 22. The drain 75*a* is projected downward from the soil chamber 75 at a predetermined length and inserted in the drain chamber 22. The filter housing will be described in detail, later.

The cover 80 has a filter 81 mounted thereon opposite to the soil chamber 75 in the filter housing 60, and on an outer side of the filter 81, there are a plurality of recovery holes 82. The recovery holes 82 are in communication with the sump 20.

The filter housing will be described with reference to FIG. 3.

The filter housing 70 is provided with a washing water inlet 72 for introduction of the washing water pumped by the impeller 42 thereto, main flow passages 73*a*, and 73*b* and a sampling flow passage 74 connected to the washing water inlet, and the soil chamber 75 connected to the sampling flow passage. To the drain 75*a* of the soil chamber, there is a valve mounted thereon for draining the washing water and the soil from the soil chamber to the drain chamber in draining.

Rotatably mounted on the washing water inlet 72 of the filter housing 70, there is a flow control valve 26 for opening/closing the main flow passages, and the flow control valve is coupled to the flow change-over unit 25 at the sump 20 with a shaft. On a circumference of the flow control valve 26, there is a rib 26*a* for opening/closing the main flow passages.

The operation of the dishwasher will be described.

The dishwasher washes dishes while the dishwasher performs cycles of pre-washing, main washing, rinsing, heated rinsing, and drying, in a sequence, or selectively. Between the cycles, a drain cycle is performed. The main washing cycle will be described.

Upon starting the main washing, the impeller 42 rotates following rotation of the washing motor. As shown in FIG. 4, the impeller pumps washing water (including detergent) from the sump 20 to the washing water inlet 72 in the pump housing 60.

Referring to FIGS. 5 and 6, the flow control valve 26 opens the two main flow passages 73*a*, and 73*b* selectively or at the same time following rotation of the flow control unit 25. According to this, a portion of washing water at the washing water inlet 72 is introduced to the upper and/or lower spray arms 4, and 6 through the main flow passages 73*a*, and 73*b*, and rest of the washing water is introduced to the soil chamber 75 through the sampling flow passage 74.

In this instance, the flow control valve 26 opens the two main flow passages 73*a*, and 73*b* at the same time, or alternately, for supplying the washing water to both of the upper/lower spray arms.

At the same time with this, there is a portion of the washing water always introduced to the sampling flow passage 74 regardless of the flow control valve 26 opening of any one of the main flow passages.

The washing water is introduced from the sampling flow passage to the soil chamber 75 directly, and overflows therefrom through the filter 81 on the soil chamber, when the filter 81 filters foreign matters from the washing water.

The washing water filtered thus, and the washing water fallen down from the upper/lower spray arms is introduced to the sump 20 through the recovery holes 82 in the cover 80, again.

Though it appears that only a portion of the washing water is filtered for a short time period, almost all of the washing water is filtered during the main washing cycle.

Upon completion of the washing cycle, a drain cycle is started.

Upon starting of the drain cycle, the drain pump 50 is put into operation. In this instance, the washing water and the soil are drawn from the sump 20 by the drain pump 50. At the same time with this, as shown in FIG. 5B, the washing water and the soil are drawn from the soil chamber 75 through the drain 75*a* by the drain pump 50. The washing water and the soil introduced to the drain pump 50 thus are drained to an outside of the dishwasher through the drain hose 9.

DISCLOSURE

Technical Problem

Because the related art dishwasher performs a washing cycle for a time period preset at a control unit, the related art dishwasher has a problem in that a washing time period is set uniformly without taking turbidity of the washing water into account. Since the washing time period can not be adjusted appropriately, the washing time period can be longer unnecessarily, to cause waste of the washing water. An object of the present invention lies on solving the problem of the related art dishwasher.

Technical Solution

The objects of the present invention can be achieved by providing a dishwasher including a sump for holding washing water, a washing pump for pumping the washing water to provide a portion of the washing water to dishes to be washed through a main flow passage, and a turbidity sensing means for sensing turbidity of the washing water, wherein the turbidity sensing means is positioned at a sampling flow passage through which the other portion of the washing water passes.

Preferably, the sampling flow passage where the turbidity sensing means is positioned is a sampling flow passage in communication with a soil chamber in the sump for filtering the washing water.

Preferably, the sampling flow passage includes a flow passage expanded portion at which the turbidity sensing means is positioned.

Preferably, the turbidity sensing means includes a light receiving device and a light emitting device for sensing turbidity of the washing water in a sensing flow passage formed between the light receiving device and the light emitting device. More preferably, [Claim 6] The dishwasher as claimed in claim 4, wherein the turbidity sensing means further includes a sensing means housing for housing the light receiving device and the light emitting device, and the sensing means housing having a sensing flow passage portion for providing a sensing flow passage between the light receiving device and the light emitting device.

Preferably, the turbidity sensing means has a top lower than a height of the sampling flow passage, and the turbidity sensing means is mounted such that the sampling flow passage and the sensing flow passage have a predetermined angle with respect to each other.

The sensing means housing has a sensing means fastening portion formed thereon, and the sump has a sensing means mounting portion on an outside for fastening to the sensing means fastening portion, wherein the sensing means mounting portion has an insertion opening for pass through of a portion of the turbidity sensing means where the light receiving portion and the light emitting portion are.

The sensing means mounting portion may include fastening projections, and the sensing means fastening portion includes fastening holes in conformity with the fastening projections. Different from this, the sensing means mounting portion may have a female thread formed in an inside surface, and the sensing means fastening portion may have a male thread in conformity with the female thread.

Preferably, the sensing means fastening portion is formed of an elastic member.

The dishwasher may further include a lower housing having the soil chamber, an upper housing for forming the sampling flow passage, and a cover mounted to cover an upper portion of the sump, having a filter arranged thereon in correspondence to the soil chamber, and recovery holes arranged in correspondence to the sump for recovery of the washing water.

In the meantime, in another aspect of the present invention, a method for controlling a dishwasher includes the steps of putting a washing pump into operation, detecting turbidity of the washing water, adjusting a washing time period preset at a control unit according to the turbidity detected thus, and operating the washing pump according to the washing time period adjusted thus.

In another aspect of the present invention, a method for controlling a dishwasher includes the steps of putting a washing pump into operation, detecting turbidity of the washing water, draining a portion of the washing water by operating a drain pump if it is determined that the turbidity detected thus is higher than a turbidity range preset at a control unit, and supplementing the washing water as much as the drain portion of the washing water.

The step of detecting turbidity of the washing water includes the step of determining operation of the washing pump for a predetermined time period before detecting the turbidity of the washing water.

Preferably, the method further includes the step of stopping the washing pump at the time of draining, and supplementing the washing water.

Preferably, the method further includes the steps of re-detecting the turbidity of the washing water after the washing water is supplemented, adjusting a washing time period preset at the control unit according to the turbidity re-detected thus, and operating the washing pump according to the adjusted washing time period.

Advantageous Effects

The separate sampling flow passage and the turbidity sensing means at the flow passage expanded portion of the sampling flow passage permit accurate sensing of the turbidity of the washing water.

The use of a turbidity sensing means suitable to a width of the sampling flow passage, to reduce a volume of the turbidity sensing means itself, permits to mount the turbidity sensing means to a sump of the dishwasher.

The washing time period can be adjusted appropriately by determining a state of contamination of the washing water with the turbidity sensing means, and the dishes can be washed with relatively clean water by draining, and supplementing a portion of the washing water in a case the contamination is heavy.

BEST MODE

Figure 1:
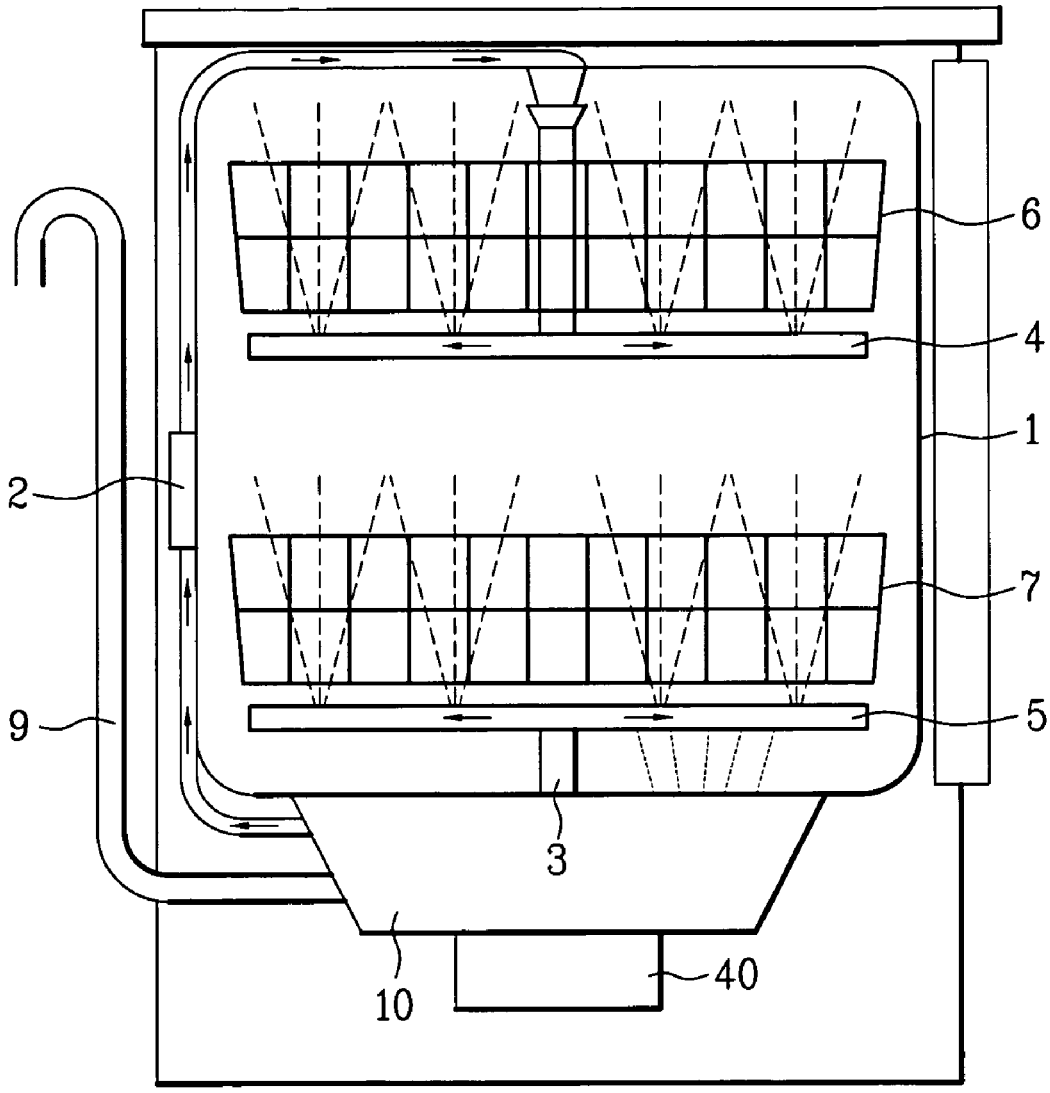
FIG. 1 Related Art
FIG. 1 illustrates a diagram of a related art dishwasher.
Figure 2:
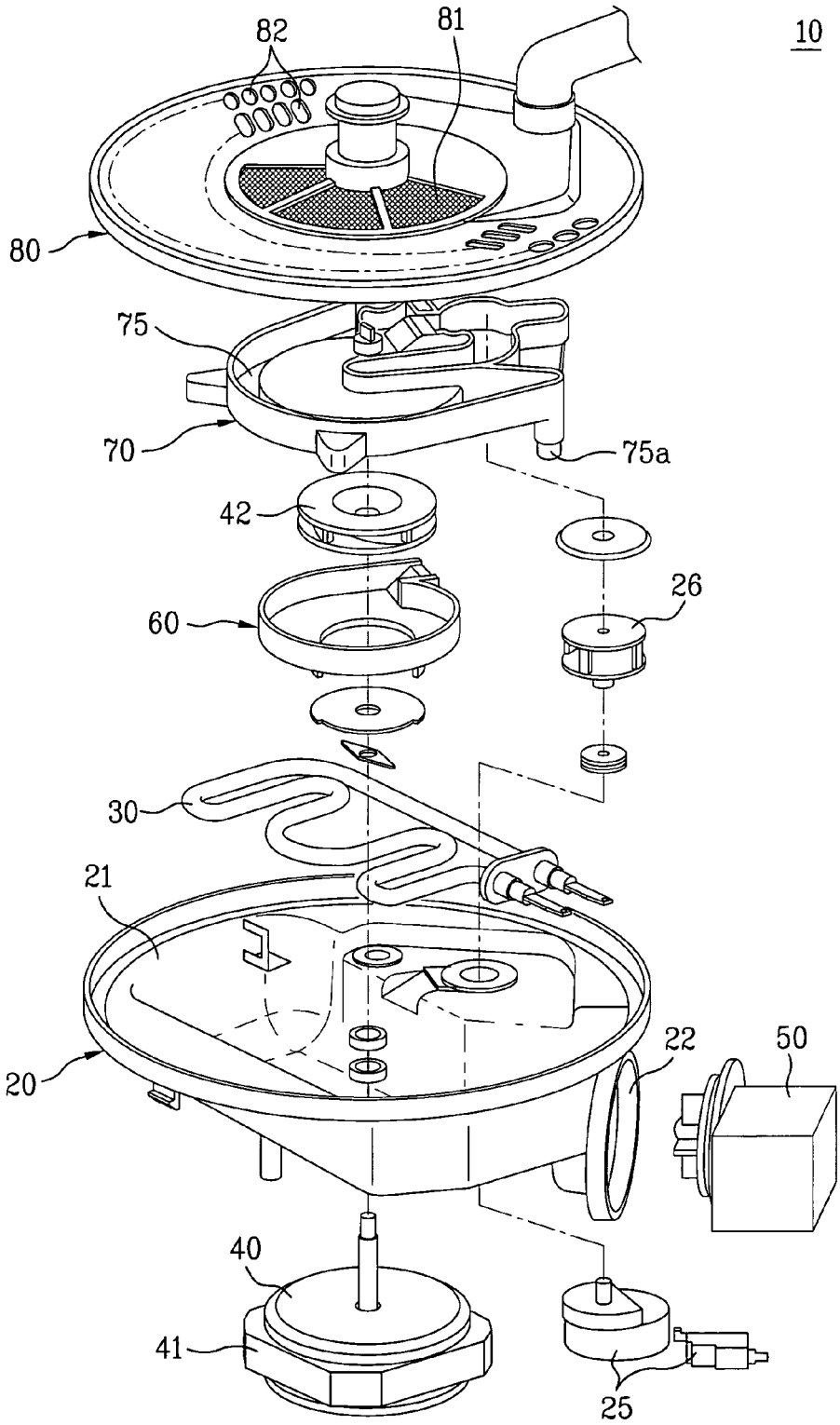
FIG. 2 Related Art
FIG. 2 illustrates an exploded perspective view of the driving unit in the dishwasher in FIG. 1.
Figure 3:
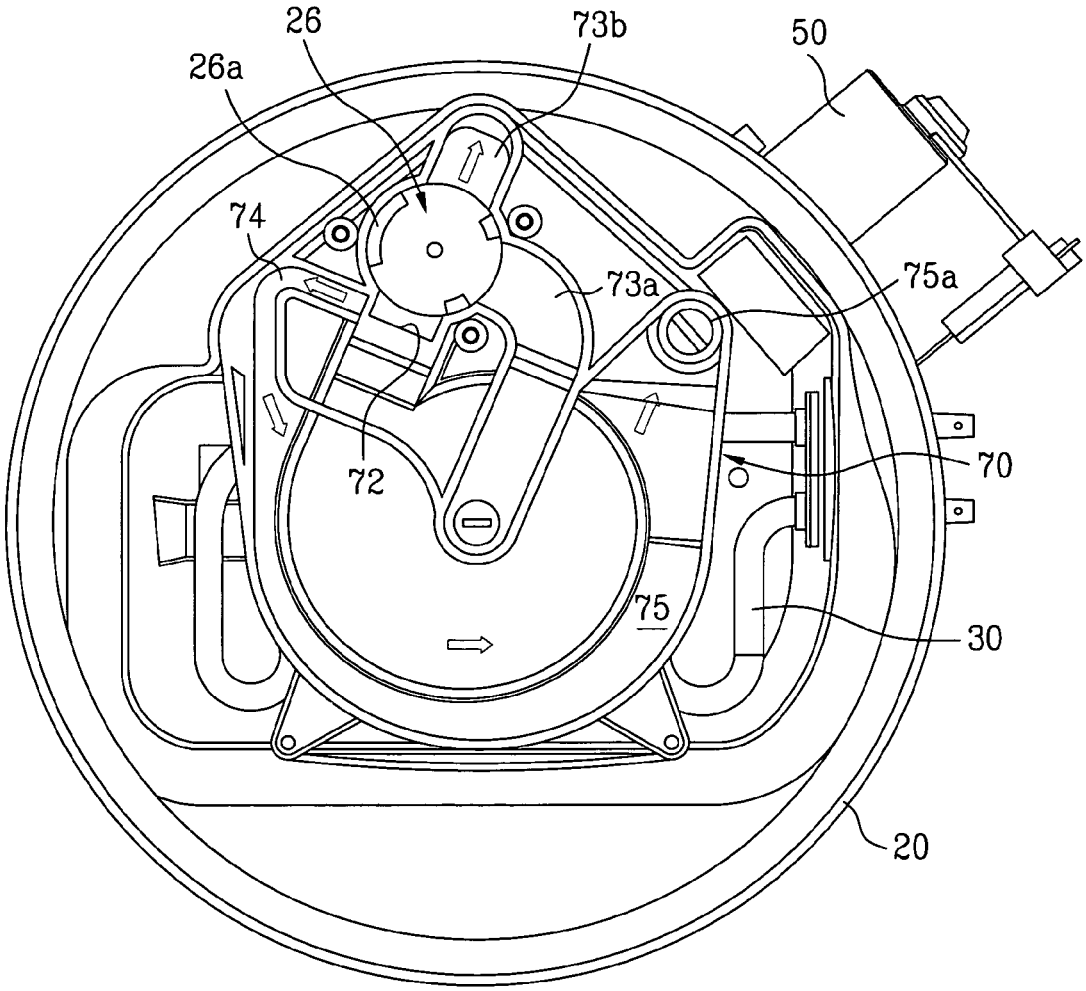
FIG. 3 Related Art
FIG. 3 illustrates a top view showing a state a cover is removed from the driving unit in FIG. 2.
Figure 4:
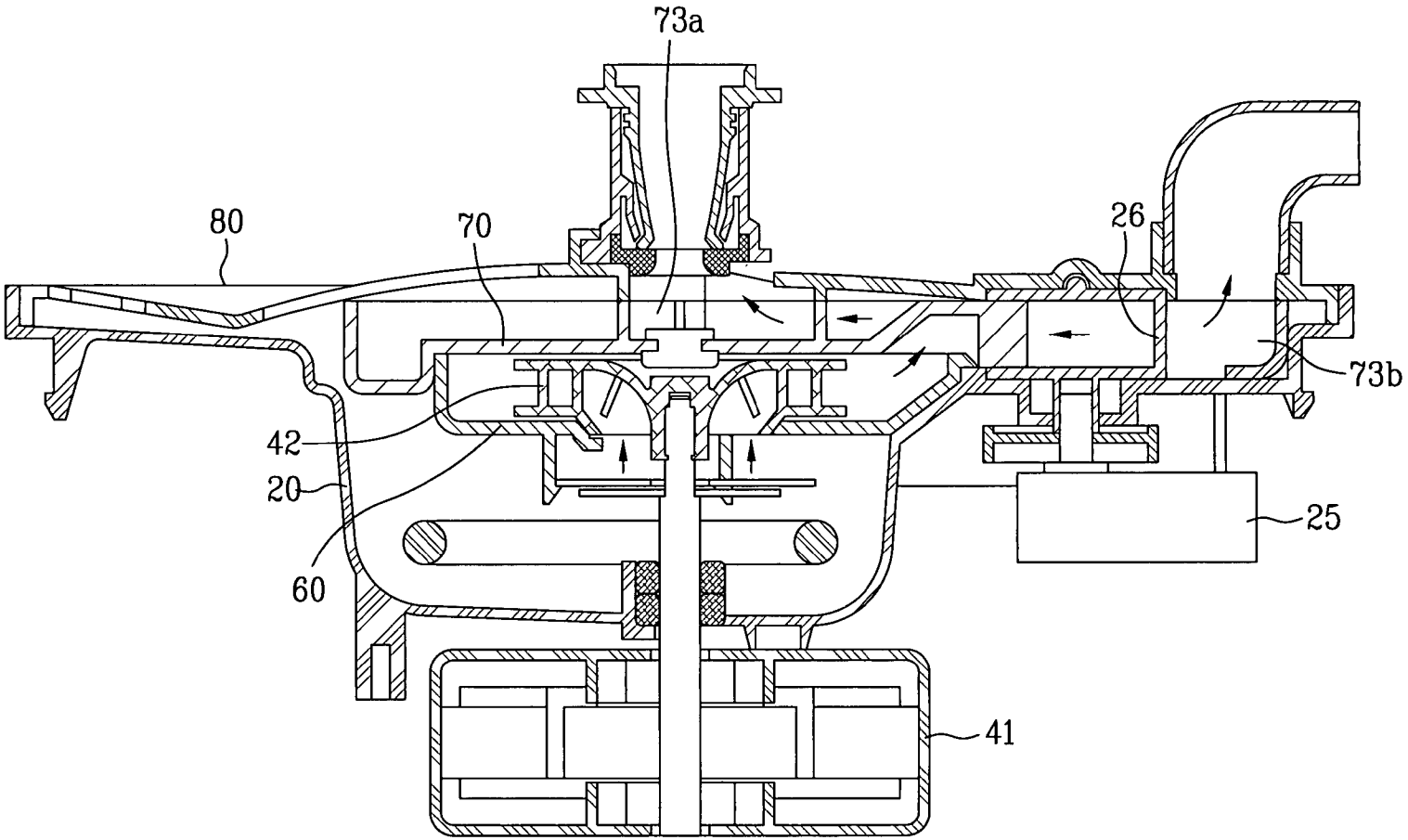
FIG. 4 Related Art
FIG. 4 illustrates a longitudinal section showing a flow of washing water in the driving unit in FIG. 2.
Figure 5:
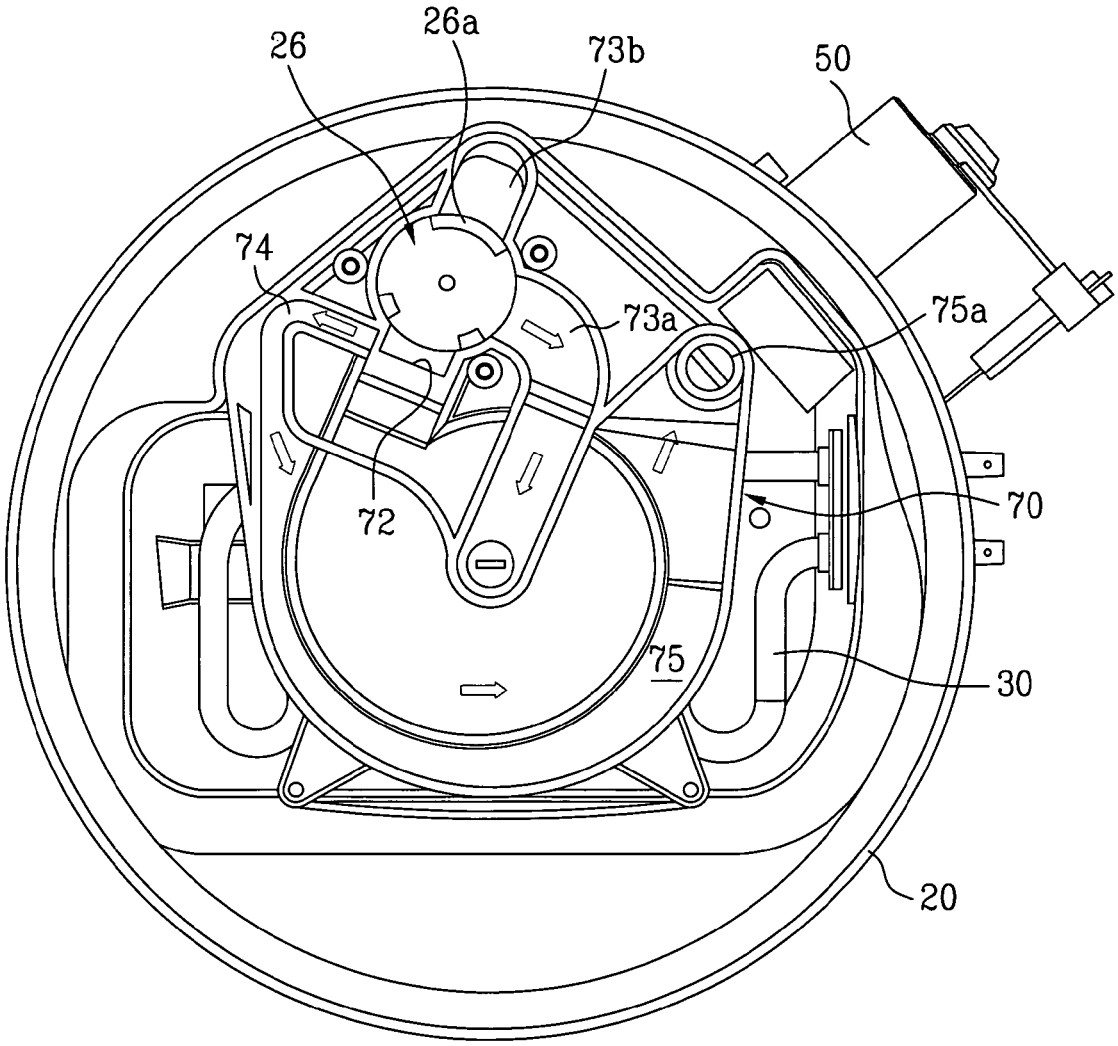
FIG. 5 Related Art
FIG. 5 illustrates a top view showing a flow of washing water when a portion of washing water is supplied to a lower arm in washing.
Figure 6:
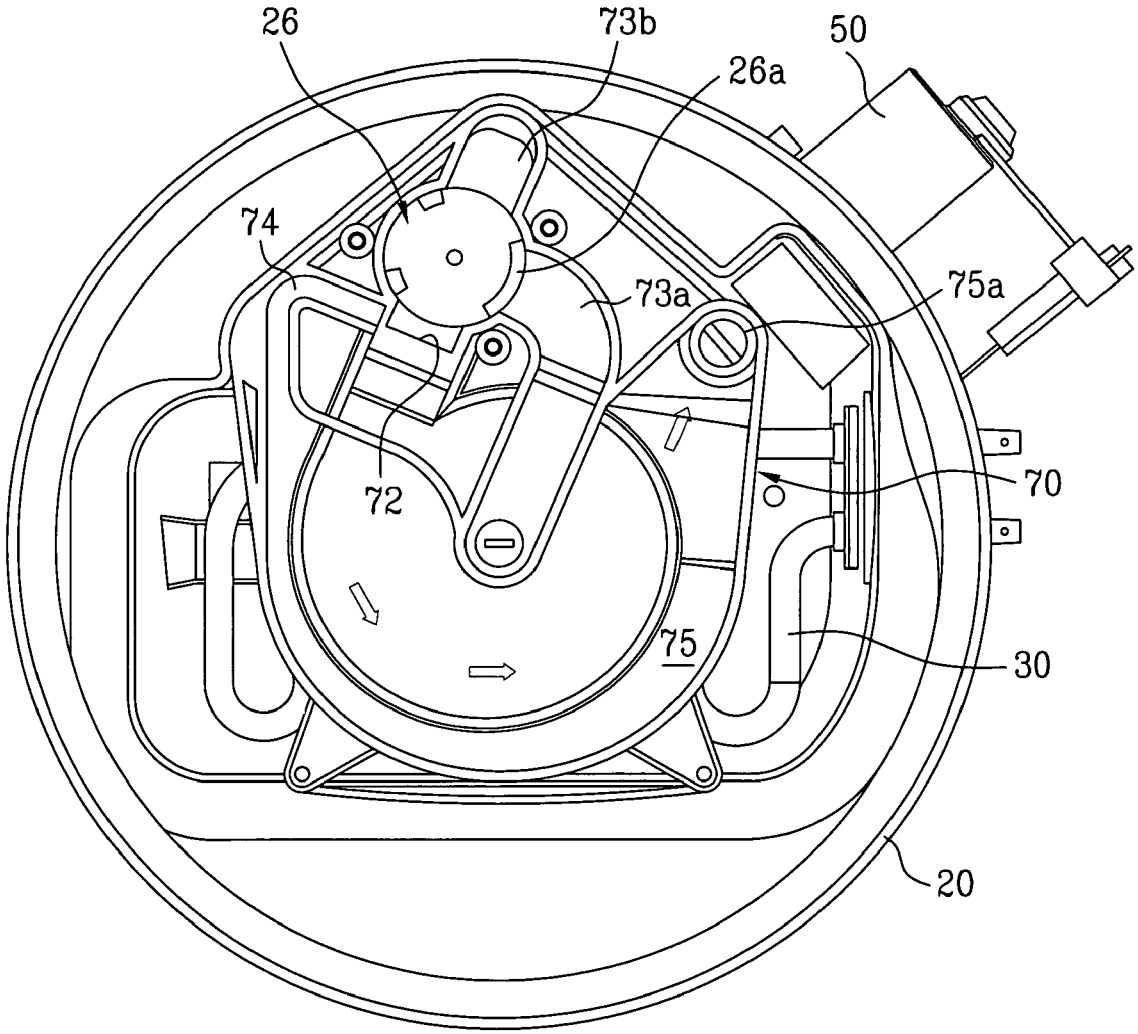
FIG. 6 Related Art
FIG. 6 illustrates a top view showing a flow of washing water when the washing water is drain in draining.
Figure 7:
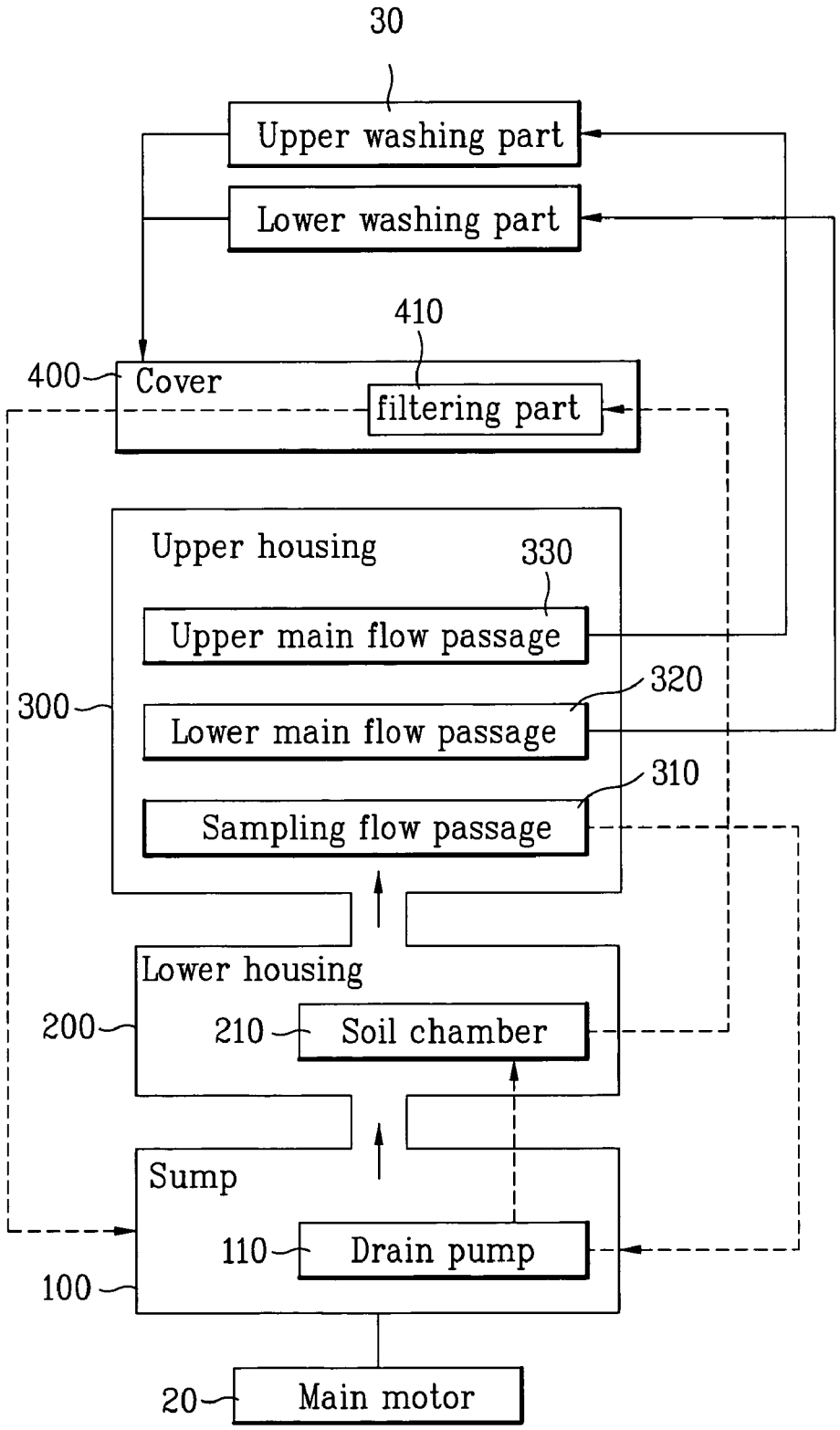
FIG. 7 illustrates a block diagram showing major units of a dishwasher in accordance with a preferred embodiment of the present invention.

Flow passages of washing water in a dishwasher of the present invention will be described with reference to FIG. 7, briefly.

The dishwasher includes a sump 100 under a washing tub for holding washing water, and a lower housing 200 over the sump 100. Over the lower housing 200, there is an upper housing 300 on which a cover 400 is mounted.

The washing water is transferred from the sump 100 to the upper housing 300 through a flow passage at the lower housing by a washing pump (not shown). Then, the washing water is moved to an upper washing arm via an upper main flow passage 330 at the upper housing 300, and to a lower washing arm via a lower main flow passage 320. A portion of the washing water is moved to a drain pump 110 through a sampling flow passage 310. The washing water passed through the drain pump 110 is introduced to a soil chamber 210 in the lower housing 200, and filtered by a filter unit 410 at the cover 400. The washing water filtered at the filter unit 410 gathers to the sump 100 again.

Since the sampling flow passage 310 is connected from the washing pump to the soil chamber 210 through the drain pump 110, a pressure applied to the filter unit 410 by the washing pump is dropped. According to this, the filter unit 410 at the cover 400 is not liable to be blocked by soil.

Figure 8:
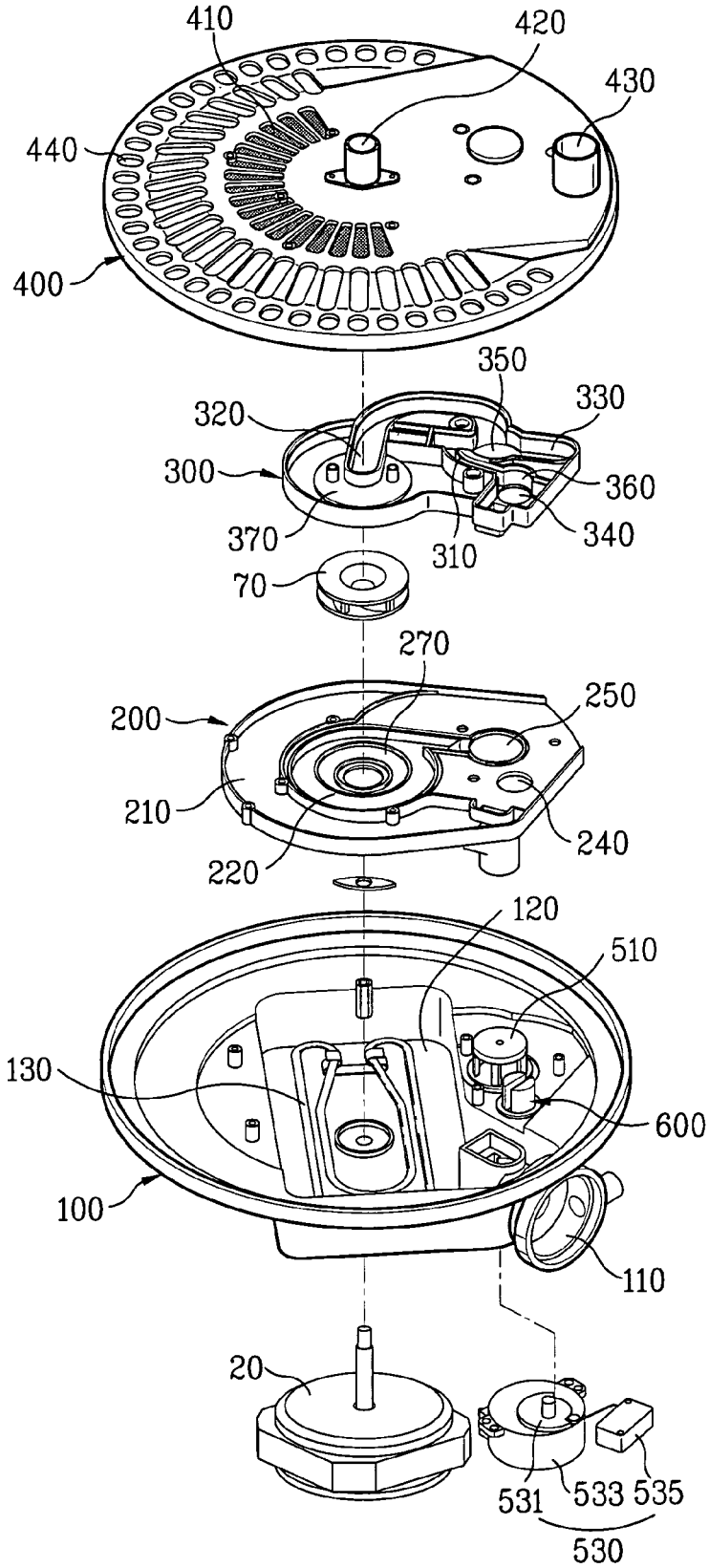
FIG. 8 illustrates an exploded perspective view of the dishwasher in FIG. 7.

The driving unit in the dishwasher in FIG. 7 will be described with reference to FIG. 8, in detail.

At a lower end of the driving unit, there is a main motor 20 for providing power to the dishwasher, and, over the main motor 20, there is a sump 100 having a washing water holding unit 120 mounted thereto for holding washing water. Over the sump 100, there is a lower housing 200 having the soil chamber 210 formed therein, and over the lower housing 200, there is an upper housing 300 having a flow passage formed therein for flow of the washing water. Over the upper housing 300, there is a cover 400 for filtering the washing water and recovering the washing water to the sump 100 again.

Inside of the sump 100, there is a heater 130, preferably always submerged in the washing water while the dishwasher is in operation. The heater 130 heats the washing water to an appropriate temperature for easy cleaning of the dishwasher. On an underside of the sump 100, there are the main motor 20 and a valve control means 530, and at one side of an outside of the sump 100, there is the drain pump 110. However, the main motor and the valve control means may be mounted to a side of an outside of the sump, and the drain pump may be mounted on an underside of the sump.

In the lower housing 200, there is an 1*a* pass through hole 240, and the soil chamber 210 for holding the washing water passed through the turbidity sensing means 600, and the drain pump 110. At a center of the lower housing 200, there is an impeller receiving portion 270 for receiving the impeller 70 therein.

On an outside of the impeller receiving portion 270, there is an introduction flow passage 220 from the impeller 70 to a flow control valve 510. At a portion connected to the introduction flow passage 220, there is a 2*a* pass through hole 250 for pass through of the flow control valve 510.

At the upper housing 300, there are an impeller cap 370 for receiving an upper portion of the impeller 70 formed thereon, and a 2*b* pass through hole 350 for pass through of the flow control valve 510 formed therein. Moreover, at the upper housing 300, there are an upper main flow passage 330 connected to the 2*b* pass through hole 350 for providing washing water to the upper washing arm, a lower main flow passage 320 for providing washing water to the lower washing arm, and a sampling flow passage 310 for providing washing water to the drain pump 110. In the sampling flow passage, there is a flow passage expanded portion 360 where turbidity sensing means 600 is positioned, and at a center of the flow passage expanded portion 360, there is an 1*b* pass through hole 340 for pass through of the turbidity sensing means. The upper housing and the lower housing may, or may not be formed as one body.

The impeller 70 is mounted between the upper housing 300 and the lower housing 200, and coupled to the motor 20 with a shaft. The impeller 70 is rotated by the motor 20, to introduce the washing water from the washing water holding portion 120 in the sump 100 to the introduction flow passage 220. That is, the impeller 70 serves as a washing pump. The washing water passed through the introduction flow passage 220 is split into the upper main flow passage 330, the lower main flow passage 320, and the sampling flow passage 310 by the flow control means. The flow control means includes the flow control valve 510 for controlling a flow direction of the washing water, valve control means 530 for controlling the flow control valve 510, and water infiltration preventive means (not shown) between the flow control valve and the valve control means. The flow control valve 510 and the valve control means are mounted on an inside of the sump, and the valve control means 530 is mounted on an underside of the sump.

At a center of the cover 400, there is a filter portion 410 for filtering the washing water, and in a periphery of the cover 400, there is recovery holes 440 of predetermined shapes. The recovery holes 440 are formed for recovery of the washing water filtered by the filter portion to an inside of the sump 100. The cover 400 has an upper arm connection portion 430 for enabling movement of the washing water from the upper main flow passage to the upper spray arm, and a lower arm connection portion 420 for enabling movement of the washing water from the lower main flow passage to the lower spray arm. The cover 400 and the upper housing 300 may be joined together as one body with thermal fusion, or mounted as separate units and fastened together with fastening means.

Figure 9:
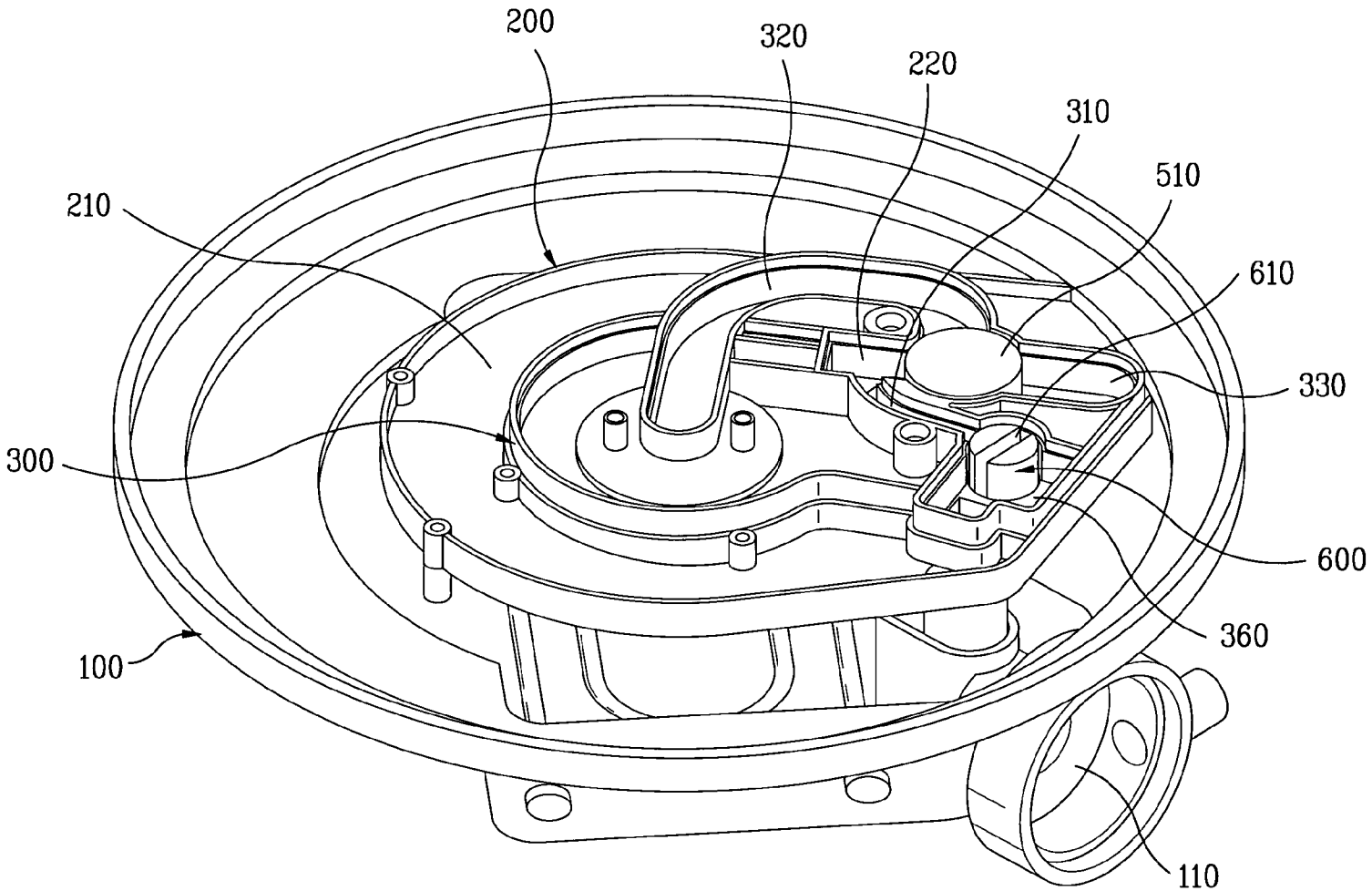
FIG. 9 illustrates a perspective view showing a mounting state of the turbidity sensing means in FIG. 8.

A mounting position, and structure of the turbidity sensing means in the sump will be described with reference to FIG. 9, in detail.

Mounted over the sump 100, there is the lower housing 200 having the soil chamber 210 formed therein, and mounted over the lower housing 200, there is the upper housing 300 having the upper main flow passage 330, the lower main flow passage 320, and the sampling flow passage 310 formed therein. In the sampling flow passage 310, there is the turbidity sensing means 600 for sensing turbidity of the washing water.

At one side of the sampling flow passage 310, there is the introduction flow passage 220 connected thereto for introduction of the washing water to the upper housing 300, and at the other side of the sampling flow passage 310, there is the drain pump 110 connected thereto. The sampling flow passage 310 has a width smaller than a width of the upper main flow passage 330 or the lower main flow passage 320. However, a portion through which the washing water is introduced to the sampling flow passage 310 may be connected to the flow control valve 510, or may be branched from the upper main flow passage or the lower main flow passage.

The turbidity sensing means 600 is mounted on the sampling flow passage 310, passed both through the 1*a* pass through hole (not shown) in the lower housing 200, and the 1*b* pass through hole (not shown) in the upper housing 300. In more detail, the turbidity sensing means 600 is mounted on the flow passage expanded portion 360 in the sampling flow passage 310. It is preferable that the flow passage expanded portion 360 is mounted on a position the upper housing 300 is connected to the drain pump 110. It is preferable that a top portion of the turbidity sensing means 600 is mounted lower than a height of the sampling flow passage, i.e., a top of the upper housing 300. As the increased cross sectional area of the flow passage expanded portion 360 makes a flow speed of the washing water to become slower at the moment the washing water enters into the flow passage expanded portion 360, that enables an accurate sensing of the turbidity of the washing water.

Moreover, a sensing flow passage of a sensing flow passage portion 610 in the turbidity sensing means 600 is mounted at a predetermined angle to the sampling flow passage 310. In more detail, it is preferable that the sampling flow passage 310 and the sensing flow passage are perpendicular to each other. Similarly, if the sampling flow passage 310 and the sensing flow passage are in a straight line, the flow speed of the washing water can be faster than a case the sampling flow passage 310 and the sensing flow passage are at a predetermined angle to each other.

Figure 10:
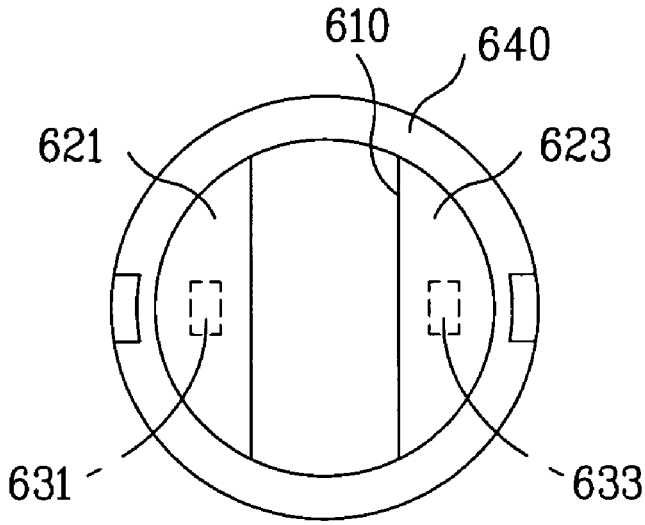
FIG. 10 illustrates a front view and a plan view of turbidity sensing means in accordance with a preferred embodiment of the present invention.
Figure 10:
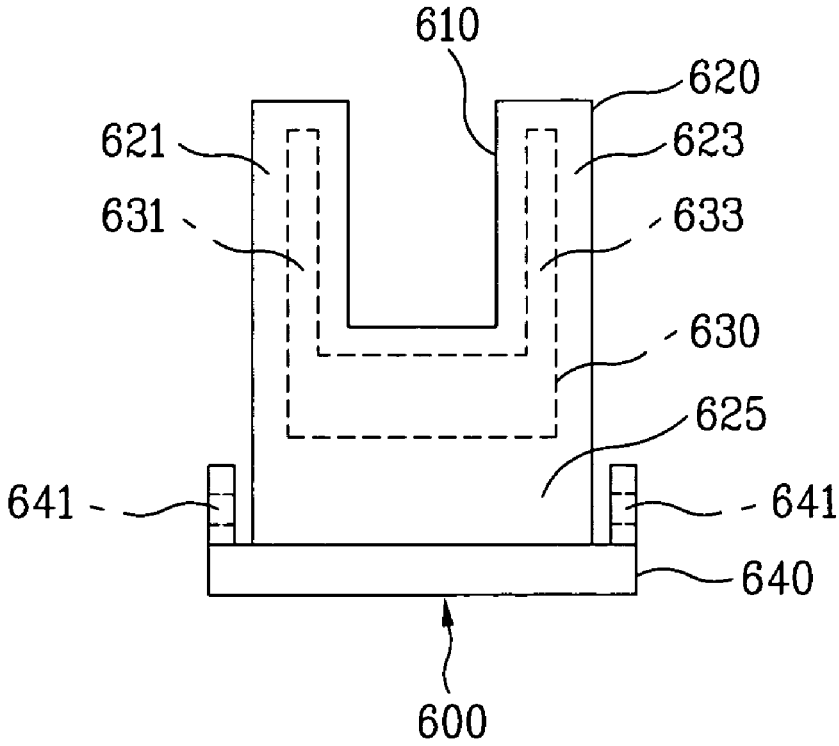

A turbidity sensing means in accordance with a preferred embodiment of the present invention will be described with reference to FIG. 10.

The turbidity sensing means 600 includes a sensing means 630 for sensing turbidity of the washing water, and a sensing means housing 620 surrounding the sensing means 630, and a sensing means fastening portion 640 at one side of the housing.

The sensing means 630 includes a light emitting device 631 for emitting a laser beam, and a light receiving device 633 for receiving the beam from the light emitting device. The light emitting device 631 and the light receiving device 633 are spaced a predetermined apart, between which the washing water flows. The light emitting device 631 directs the beam to the washing water, and the light receiving device 633 receives the beam, to sense the turbidity of the washing water with reference to the received beam.

The sensing means housing 620 includes a light receiving portion surrounding the light receiving device, a light emitting portion 621 surrounding the light emitting device, and a base portion 625 holding the light receiving portion and the light emitting portion. Between the light receiving portion 623 and the light emitting portion 621, a sensing flow passage portion 610 is formed to provide a sensing flow passage through which the washing water flows. The sensing flow passage is connected to the sampling flow passage in the upper housing.

The sensing means fastening portion 640 at one side of the sensing means housing 620 fastens the turbidity sensing means 600 to the sump. The sensing means fastening portion 640 has a certain shape of fastening hole 641 in correspondence to a fastening projection on a lower portion of an outside of the sump. It is preferable that the sensing means fastening portion 640 is formed of an elastic material, and there are at least one fastening hole 641.

Figure 11:
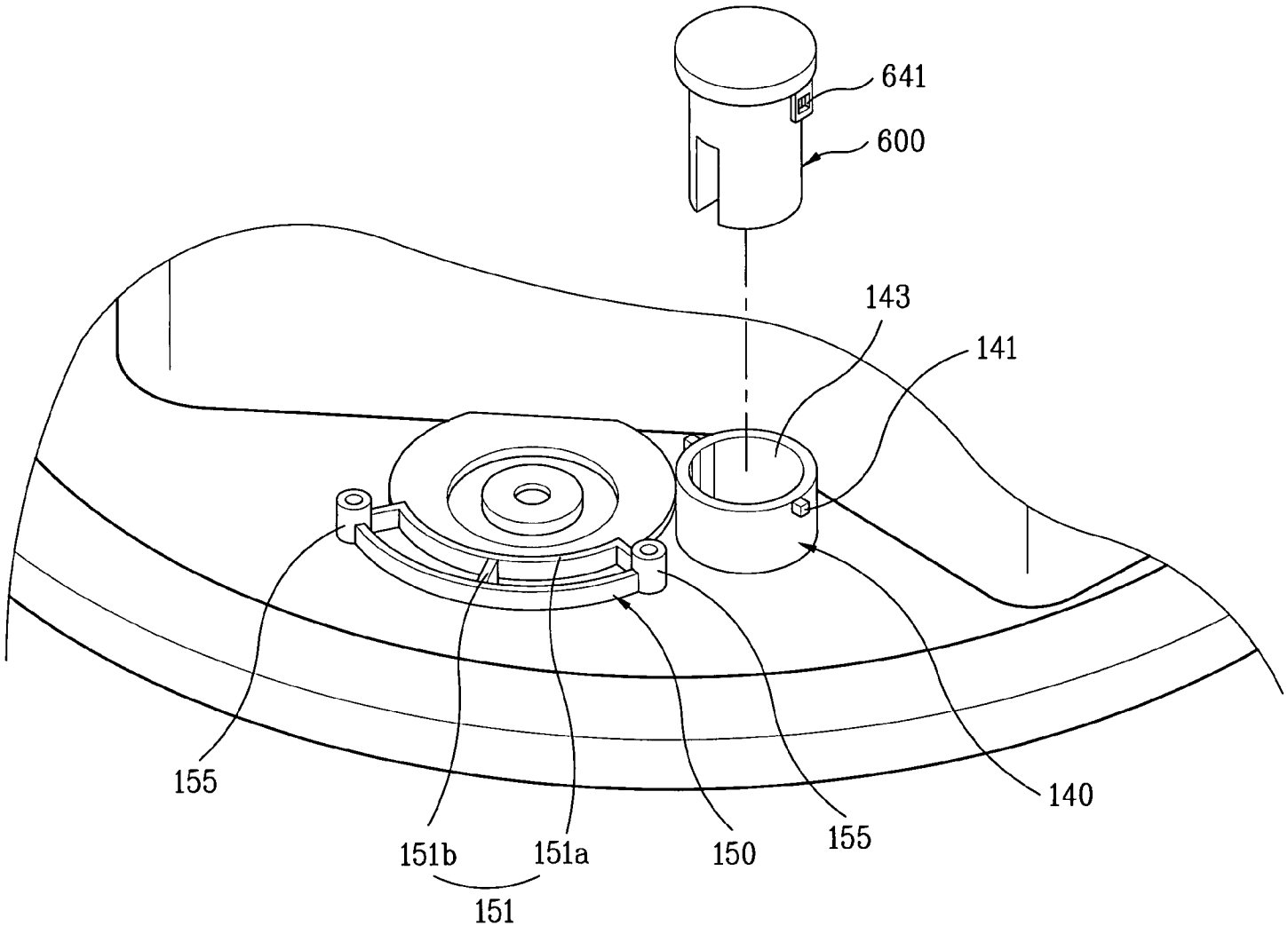
FIG. 11 illustrates an exploded perspective view showing a mounting state of the turbidity sensing means in FIG. 10.

A structure in which the turbidity sensing means is fastened to the lower portion of an outside of the sump will be described in detail with reference to FIG. 11.

Formed side by side at the outside of the sump, there are a driving means mounting portion 150 for mounting a motor for driving the flow control valve (not shown) thereon and a sensing means mounting portion 140 for mounting the turbidity sensing means 600 thereon.

The sensing means mounting portion 140 is projected from the lower portion of an outside of the sump 100, and has an insertion hole 143 formed therein for inserting the turbidity sensing means 600. In more detail, the sensing means mounting portion 140 has a cylinder shape of a predetermined length with opened both ends. It is preferable that the length of the sensing means mounting portion 140 is shorter than an entire length of the turbidity sensing means 600. However, the sensing means mounting portion 140 may have any shape as far as the shape is in conformity with the turbidity sensing means. For an example, if the turbidity sensing means is hexahedral, the sensing means mounting portion 140 has a shape of a rectangular cylinder.

In the meantime, the sensing means mounting portion 140 has fastening projections 141 of a predetermined shape on an outside circumferential surface, in conformity with fastening holes 641 in the sensing means fastening portion of the turbidity sensing means. At least one fastening projection 141 is formed on the outside circumferential surface of the sensing means mounting portion, and may have any shape as far as the shape is in conformity with the fastening hole.

Figure 13:
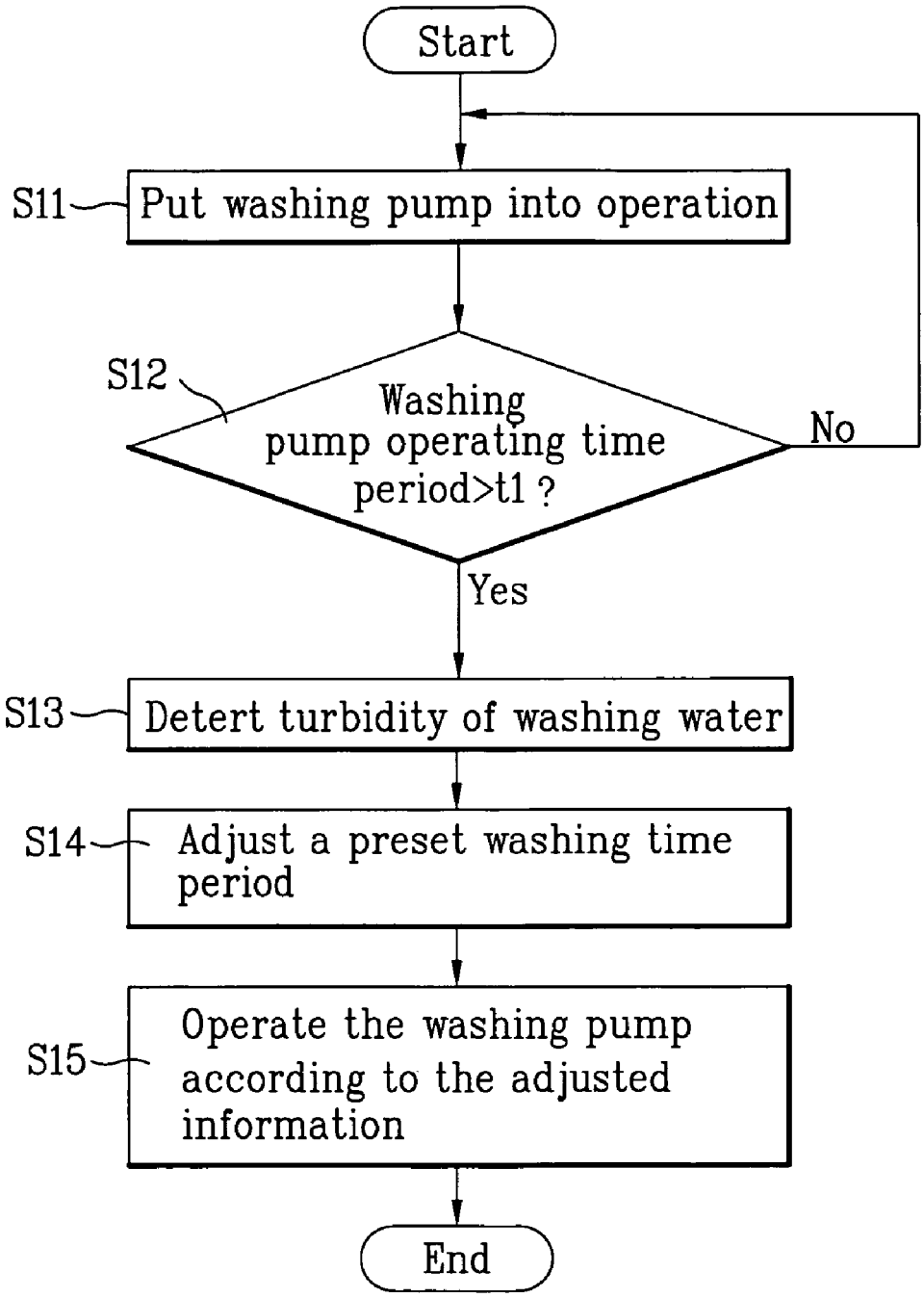
FIG. 13 illustrates a flow chart showing the steps of a method for controlling a driving unit in a dishwasher in accordance with a first preferred embodiment of the present invention.

A control method in accordance with a preferred embodiment of the present invention will be described with reference to FIG. 13.

Upon starting washing, the washing pump is operated (S11). In this instance, a portion of the pumped washing water is lead to the spray arms, and rest of the washing water is filtered as the washing water overflows from the soil chamber.

Then, the turbidity sensing means detects turbidity of the washing water (S13). In this instance, it is more preferable that the turbidity of the washing water is determined after the washing pump is operated for a predetermined time period (t1) (S12), for determining the turbidity after the washing water is contaminated, adequately.

A washing time period set at a control unit is corrected with reference to the detected turbidity. For an example, a weighted value is applied to a reference washing time period set at the control unit according to the turbidity. In this instance, it is required that the reference washing time period and the weighted value are adjusted appropriately taking a capacity of the dishwasher, the reference washing time period, and the like into account.

The washing pump is operated as long as the washing time period corrected thus (S15), to wash the dishes on the upper/lower racks.

According to the control method, the washing time period can be shortened by adjusting the washing time period appropriately according to the turbidity of the washing water.

Mode for Invention

Figure 12:
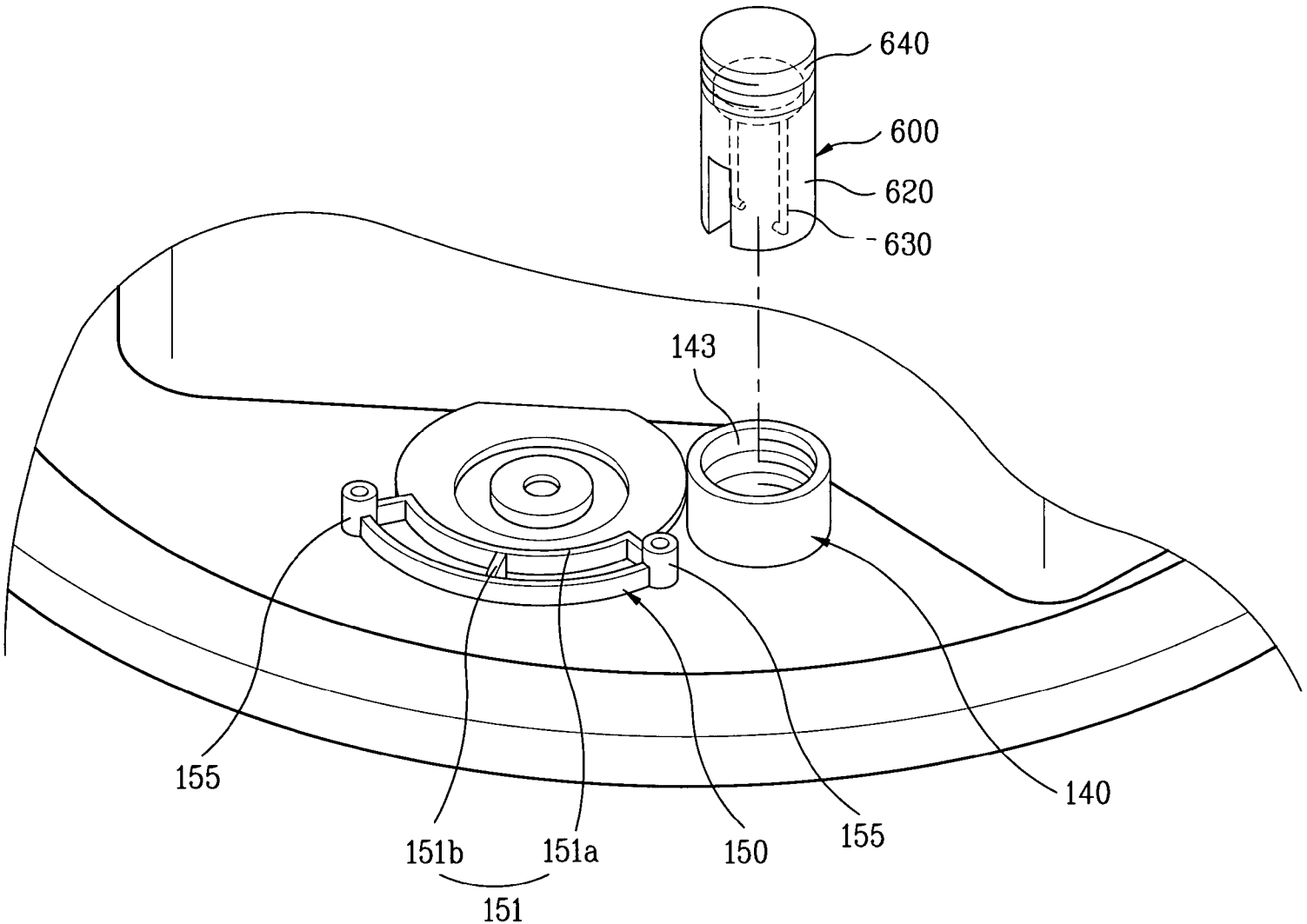
FIG. 12 illustrates an exploded perspective view showing a mounting state of turbidity sensing means in accordance with another preferred embodiment of the present invention.

A turbidity sensing means in accordance with another preferred embodiment of the present invention will be described with reference to FIG. 12.

Alike the foregoing embodiment, the turbidity sensing means 600 includes sensing means 630 for sensing turbidity of the washing water, a sensing means housing 620 surrounding the sensing means, and a sensing means fastening portion 640 at one side of he housing. The turbidity sensing means 600 is fastened to the sensing means mounting portion 140 at a lower portion of an outside of the sump. However, different from the first embodiment, the sensing means fastening portion 640 has a male thread portion formed on a circumference of the sensing means fastening portion to be fastened to a female portion in the sensing means mounting portion 140. However, a variety of fastening means may be used for the sensing means fastening portion, such that the sensing means fastening portion is fastened to the sensing means by inserting in a shape of a cap.

Figure 14:
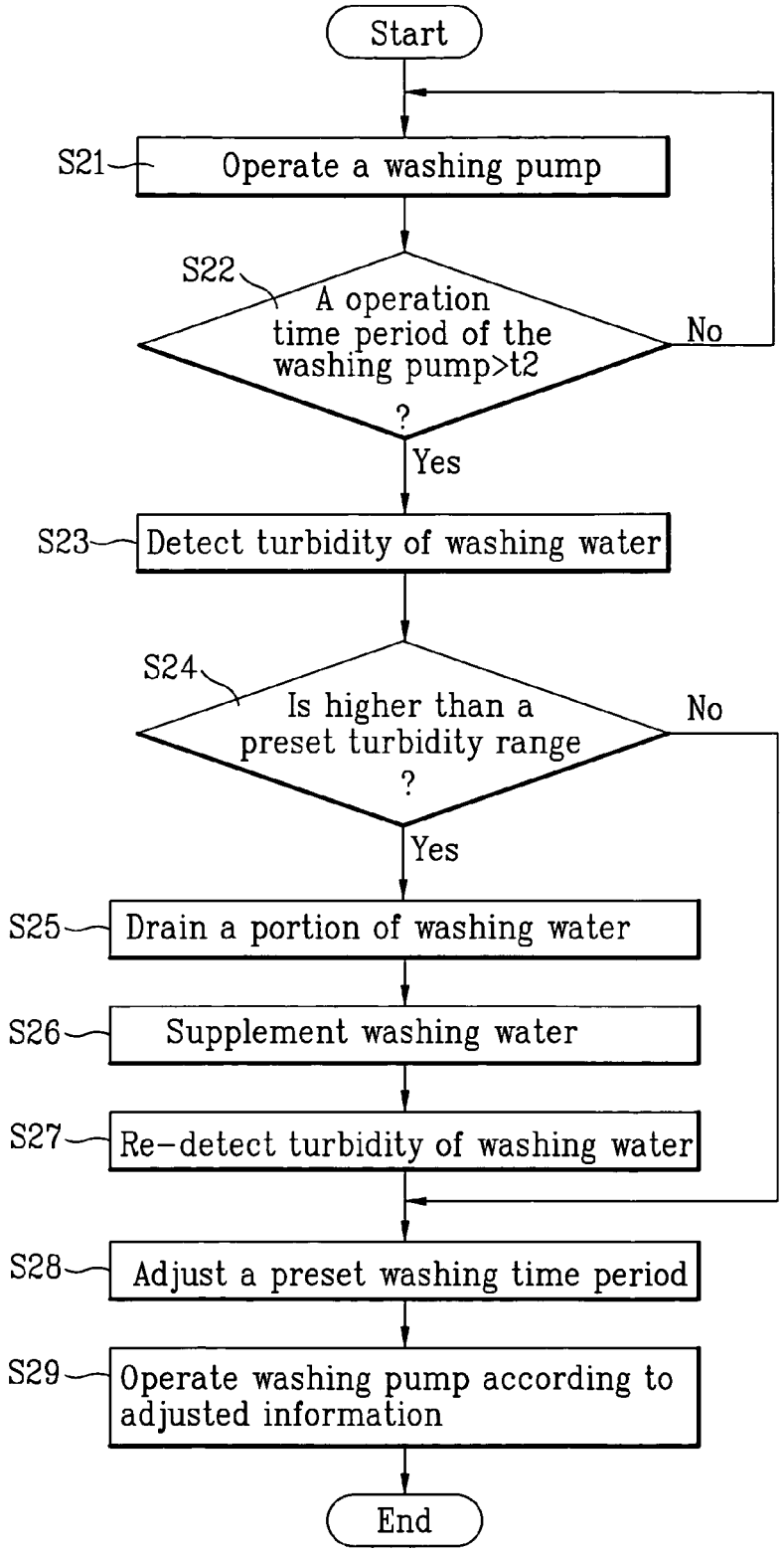
FIG. 14 illustrates a flow chart showing the steps of a method for controlling a driving unit in a dishwasher in accordance with a second preferred embodiment of the present invention.

A control method in accordance with another preferred embodiment of the present invention will be described with reference to FIG. 14.

Upon starting washing, the washing pump is operated (S21). In this instance, a portion of pumped washing water is lead to the spray arms, and rest of the pumped washing water overflows from the soil chamber, and filtered.

Then, the turbidity sensing means detects turbidity of the washing water (S23). It is more preferable that the turbidity of the washing water is determined after the washing pump is operated for a predetermined time period (t2) (S22).

Next, it is determined whether the detected turbidity is higher than a turbidity range preset at the control unit (S24). If the detected turbidity is lower than the preset turbidity range, a washing time period preset at the control unit is adjusted according to the turbidity (S28). If the detected turbidity is higher than the preset range, the drain pump is operated, to drain a portion of the washing water from the sump (S25). It is preferable that an amount of the drain of the washing water is adjusted according to the detected turbidity. For an example, by setting the amount of drain of washing water at the control unit, the amount of drain of the washing water can be adjusted appropriately. In this instance, it is preferable that the setting range of the turbidity is applied to a case the washing water is heavily contaminated.

After the portion of the washing water is drained, the washing water is supplemented as much as the amount of drained washing water (S26). Then, the turbidity sensing means detects the turbidity of the washing water, again (S27). In this instance, it is preferable that the re-detection of the turbidity of the washing water is performed after a predetermined time period is passed after the washing water supplementation.

The washing time period preset at the control unit is adjusted according to the re-detected turbidity (S28). For an example, a weighted value is applied to a reference washing time period preset at the control unit according to the turbidity. It is required that the reference washing time period and the weighted value are adjusted appropriately taking a capacity of the dishwasher, and the reference washing time period into account.

The washing pump is operated as much as the washing time period adjusted thus (S29), to wash the dishes on the upper/lower racks.

By draining a portion of washing water, and supplementing the drained washing water, the control method permits to perform washing with washing water which is contaminated less.

INDUSTRIAL APPLICABILITY

As the dishwasher of the present invention has the following distinctive advantages, the dishwasher is applicable to the industry favorable.

First, the separate sampling flow passage and the turbidity sensing means at the flow passage expanded portion of the sampling flow passage permit accurate sensing of the turbidity of the washing water.

Second, the use of a turbidity sensing means suitable to a width of the sampling flow passage, to reduce a volume of the turbidity sensing means itself, permits to mount the turbidity sensing means to a sump of the dishwasher.

Third, the washing time period can be adjusted appropriately by determining a state of contamination of the washing water with the turbidity sensing means, and the dishes can be washed with relatively clean water by draining, and supplementing a portion of the washing water in a case the contamination is heavy.

Other than above, many excellent advantages derived from nature of the present invention are expected, and the advantages can be derived by embodying the present invention as it is.

The invention claimed is:

1. A method for controlling a dishwasher comprising the steps of:

putting a washing pump into operation;

operating the washing pump for a predetermined time period;

detecting turbidity of the washing water;

adjusting a washing time period preset at a control unit according to the turbidity detected thus; and operating the washing pump according to the washing time period adjusted thus.

2. A method for controlling a dishwasher comprising the steps of:

putting a washing pump into operation;

operating the washing pump for a predetermined time period;

detecting turbidity of the washing water;

draining a portion of the washing water by operating a drain pump if it is determined that the turbidity detected thus is higher than a turbidity range preset at a control unit; and supplementing the washing water as much as the drain portion of the washing water.

3. The method as claimed in claim 2, further comprising the step of stopping the washing pump at the time of draining, and supplementing the washing water.

4. The method as claimed in claim 2, further comprising the step of adjusting an amount of draining of the washing water according to the turbidity detected thus.

5. The method as claimed in claim 2, further comprising the steps of:

re-detecting the turbidity of the washing water after the washing water is supplemented;

adjusting a washing time period preset at the control unit according to the turbidity re- detected thus; and operating the washing pump according to the adjusted washing time period.

6. The method as claimed in claim 5, wherein the turbidity of the washing water is re-detected if a predetermined time period is passed after the supplementation of the washing water.

* * * * *